US005170038A

United States Patent [19]

Aida

[11] Patent Number: 5,170,038

[45] Date of Patent: Dec. 8, 1992

[54] IRON UNIT ADAPTED TO BE USED WITH HAIR DRYERS

[75] Inventor: Masaaki Aida, Tokyo, Japan

[73] Assignee: Midori Co., Ltd., Tokyo, Japan

[21] Appl. No.: 734,686

[22] Filed: Jul. 23, 1991

[51] Int. Cl.[5] ..... D06F 75/02; D06F 75/38; D06F 75/30; A45D 20/12

[52] U.S. Cl. ..... 219/249; 34/91; 34/243 R; 38/69; 38/82; 38/97; 219/228; 219/245; 392/379; 392/383

[58] Field of Search ..... 219/245-249, 219/259, 228; 38/75, 82, 93, 69, 97; 34/91, 243 R, 90, 96-101; 392/379-385

[56] References Cited

U.S. PATENT DOCUMENTS

| | | | |
|---|---|---|---|
| 2,585,758 | 2/1952 | Fjermestad | 219/246 X |
| 4,524,263 | 6/1985 | Yamac | 219/249 |
| 4,685,229 | 8/1987 | Moravek et al. | 38/93 |
| 4,857,706 | 8/1989 | Diamond | 219/245 X |

FOREIGN PATENT DOCUMENTS

| | | | |
|---|---|---|---|
| 3605778 | 10/1986 | Fed. Rep. of Germany | 219/245 |
| 675103 | 10/1928 | France | 219/259 |

*Primary Examiner*—Anthony Bartis
*Attorney, Agent, or Firm*—Wenderoth, Lind & Ponack

[57] ABSTRACT

An iron unit adapted to be used with a hair dryer includes an ironing plate formed of a heat conductor having a groove and an exhaust groove in communication with the groove on a lower side thereof providing a contact surface with an object to be heated, and a plurality of air outlets extending from the upper side to the groove. A hot air source receiver includes a mounting plate having a cylindrical member engageable with the hair dryer for supplying hot air. A hot air-feeding space is in communication within the cylindrical member. The mounting plate is attached to the ironing plate, with the hot air-feeding space being in communication with the outside through a plurality of passages. A covering member defines a space on the outside of the engaging cylindrical member of the hot air source receiver. The mounting plate is attached in place with the space being in communication with the outside on the side of the cylindrical member and on the peripheral side of the mounting plate. The iron unit may further include a holder for holding the iron plate.

8 Claims, 8 Drawing Sheets

IRON UNIT ADAPTED TO BE USED WITH HAIR DRYERS

BACKGROUND OF THE INVENTION

1. Field of the Invention

The present invention relates to an iron unit designed to be used with available hair dryers and, more particularly, to an iron unit for making use of hot air from a hot air source of an available hair dryer to iron out an object to be heated, such as clothing.

2. Statement of the Prior Art

A conventional iron unit used with a hair dryer includes a cylindrical support having a heating element, which is attached to a hot air blower of the hair dryer. For ironing out an object to be heated, such as clothing, the ironing plate is heated by hot air from the hair dryer. See Japanese Utility Model Laid-Open Nos. 52(1977)-15978 and 56(1981)-30802.

A problem with such a conventional unit as mentioned above, however, is that the ironing plate becomes too hot to perform proper ironing, since measures are not always taken so as to remove heat from the ironing plate.

The present invention, accomplished with this problem in mind, has for its object an iron unit designed to be used with available hair dryers, which can prevent a ironing plate from becoming too hot, is easy to handle and is provided with superior safety features.

SUMMARY OF THE INVENTION

According to one aspect of this invention, there is provided an iron unit adapted to be used with an available hair dryer. An ironing plate is formed of a heat conductor, which has a groove, and an exhaust groove in communication with the groove in a certain region of the lower side thereof providing a contact surface with an object to be heated, and a plurality of air outlets extending from the upper side to the groove. A mounting plate has cylindrical member engageable with the hair dryer for supplying hot air and a hot air-feeding space in communication within the cylindrical member. A hot air source receiver includes the mounting plate and the cylindrical member. The mounting plate is attached to the ironing plate, and the hot air-feeding space is in communication with the outside through a plurality of positions. A covering member defines a space on the outside of the engaging cylindrical member of the hot air source receiver and the mounting plate, the covering member being attached in place while the space is in communication with the outside on the side of the cylindrical member and on the peripheral side of the mounting plate.

According to another aspect of this invention, there is provided an iron unit adapted to be used with an available hair dryer. An ironing plate is formed of a heat conductor, and has a groove, and an exhaust groove in communication with the groove in a region on the lower side thereof providing a contact surface with an object to be heated and a plurality of air outlets extending from the upper side to the groove. A hot air source receiver includes mounting plate having a cylindrical member engageable with the hair dryer for supplying hot air, and a hot air-feeding space is in communication within the cylindrical member. The mounting plate is attached to the ironing plate, while the hot air-feeding space is in communication with the outside through a plurality of positions. A covering member defines a space on the outside of the engaging cylindrical member of the hot air source receiver and the mounting plate, the covering member being attached in place while the space is in communication with the outside on the side of the cylindrical member and on the peripheral side of the mounting plate. A holder includes a holder plate on which the ironing plate can be placed, a leg for holding the holder plate up from the floor and a vent hole extending through the holder plate.

With the iron unit according to the first aspect of this invention, hot air is supplied from the hair dryer serving as a hot air source to the ironing plate through the cylindrical member and hot air-feeding space of the hot air source receiver, so that the ironing plate can be heated and the hot air can be blown from the air outlets onto the object to be heated, which is in close contact with the lower side of the ironing plate. At this time, a part of the hot air escapes to the outside through the groove and exhaust groove formed in the lower side of the ironing plate, while the air heated in the space defined by the covering member and the cylindrical member/mounting plate escapes to the outside from the side of the covering member facing the cylindrical member and the periphery of the mounting plate, so that such air can be prevented from becoming too hot. Thus, the whole iron unit can be prevented from becoming too hot.

With the iron unit according to the second aspect of this invention, such similar effects as mentioned above can be obtained. In addition, even when the ironing plate is heated by the hair dryer while it is placed on the holder, hot air blown out of the air outlets in the ironing plate escapes outside through the vent hole formed in the holder plate from between the legs. Thus, the ironing plate can be prevented from becoming too hot.

BRIEF DESCRIPTION OF THE DRAWINGS

The present invention will now be explained in greater detail with reference to the accompanying drawings, in which.

DETAILED EXPLANATION OF THE PREFERRED EMBODIMENTS

Figure 1:
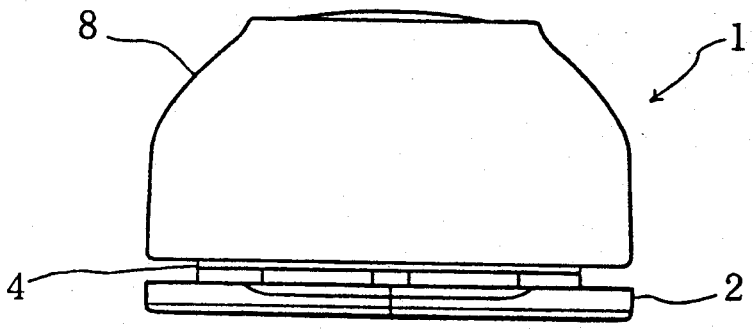
FIG. 1 is front view of an embodiment according to a first aspect of the present invention.
Figure 2:
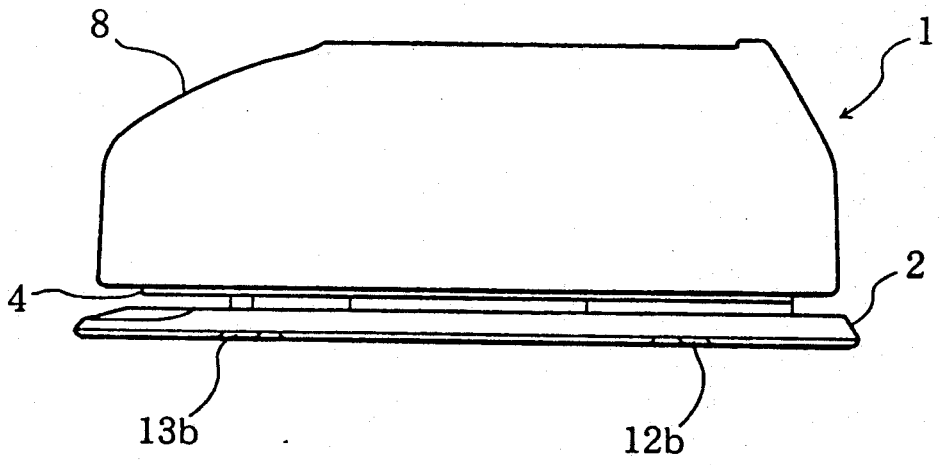
FIG. 2 is a side view of the embodiment of FIG. 1

Referring to FIGS. 1 to 5, there is illustrated an iron device shown generally at 1, which is used with an available hair dryer. This device 1 includes a substantially oval ironing plate 2 made of a heat conductor, a hot air source receiver 6 comprising a substantially oval mounting plate 4 screwed onto the upper face of the ironing plate 2 by means of a screws 3 and an engaging cylindrical member 5 extending upwardly from the central portion of the plate 4, and a covering member 8 engaged with the receiver 6 while leaving a space 7 above the plate 4 and around the member 5.

Figure 7:
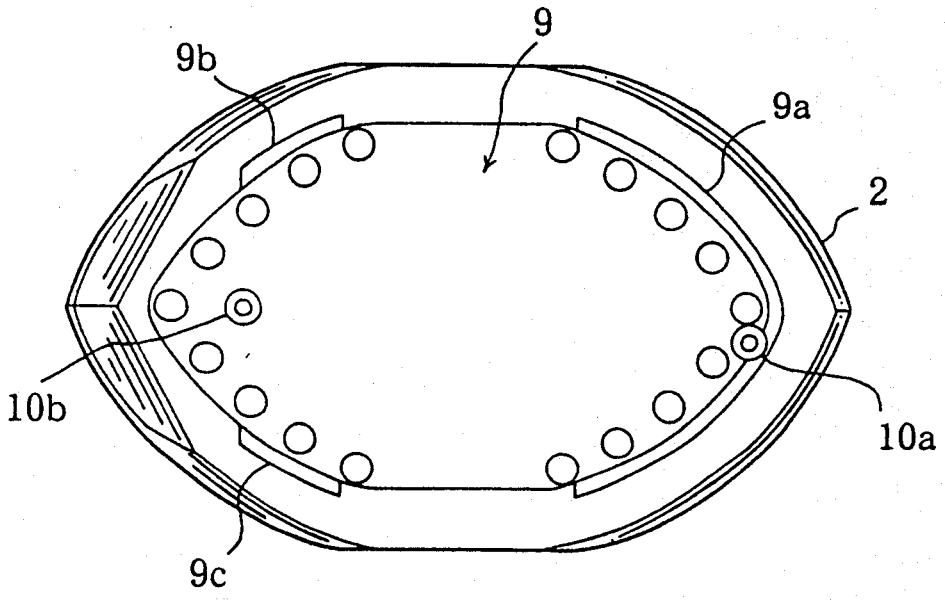
FIG. 7 is a plan view of an ironing plate used in that embodiment.
Figure 8:
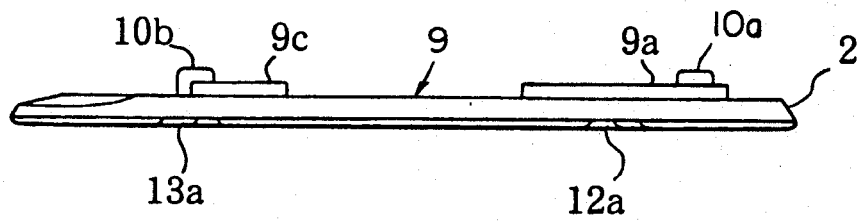
FIG. 8 is a side view of the ironing plate of FIG. 7
Figure 9:
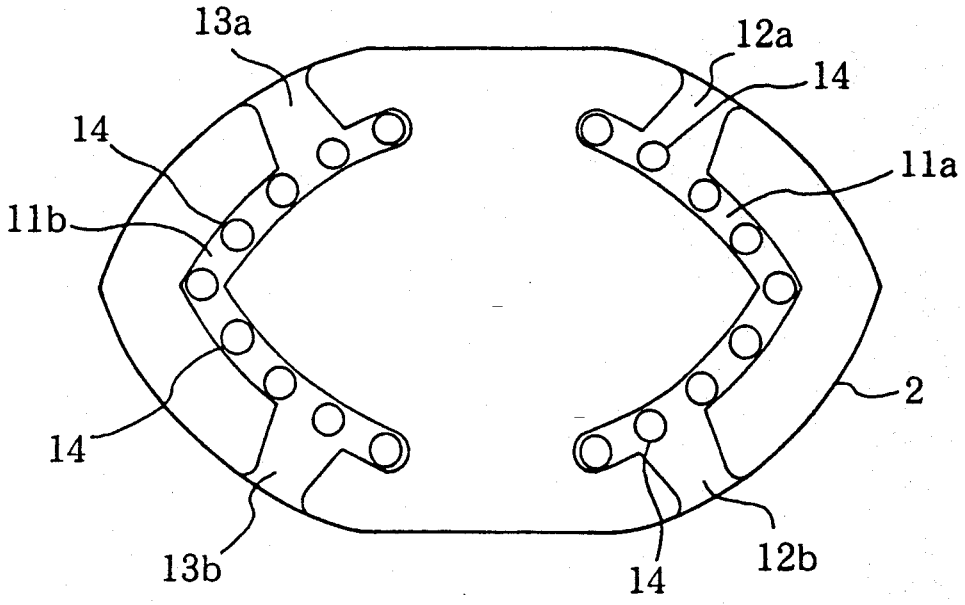
FIG. 9 is a bottom view of the ironing plate of FIG. 7.

As also shown in FIGS. 7–9, the ironing plate 2 is provided on its upper side with a recess 9 of a substantially oval shape corresponding to the contour of a substantially oval shape. The recess 9 is provided on its right-handed edge with a first ridge 9*a* of an inverted C shape, which is to contact the plate 4. On the left-handed edge of the recess 9, as illustrated in FIG. 7, there are symmetrically located second and third ridges 9*b* and 9*c*, each being about 1 cm in length. On the recess 9, is provided a first, internally threaded, screw-receiving member 10*a* which is located in the vicinity of the right-hand end of the first ridge 9*a* and a second, internally threaded, screw-receiving member 10*b* which is located in the vicinity of the left-hand end of the recess 9.

On the lower side of the ironing plate 2, as illustrated in FIG. 9, are symmetrically located a pair of C-shaped grooves 11*a* and 11*b*, in which air outlets 14 are to be positioned. As also shown in FIG. 9, exhaust grooves 12*a* and 12*b*, terminating at the outer periphery of the ironing plate 2, are symmetrically positioned on both end portions of the groove 11*a*. Exhaust grooves 13*a* and 13*b* are similarly provided for groove 11*b*. The ironing plate 2 is further provided with a number of air outlets 14 extending through it. Although a total of eighteen (18) air outlets, nine (9) outlets on each side, are symmetrically located in the illustrated embodiment, it is noted that no limitation is imposed upon how many such outlets are provided.

As illustrated in FIGS. 3–6, the hot air source receiver comprises comprising the substantially oval mounting plate 4, somewhat smaller in entire size than the ironing plate 2, and the engaging cylindrical member 5, is formed of a synthetic resin by an one-piece molding technique.

Figure 3:
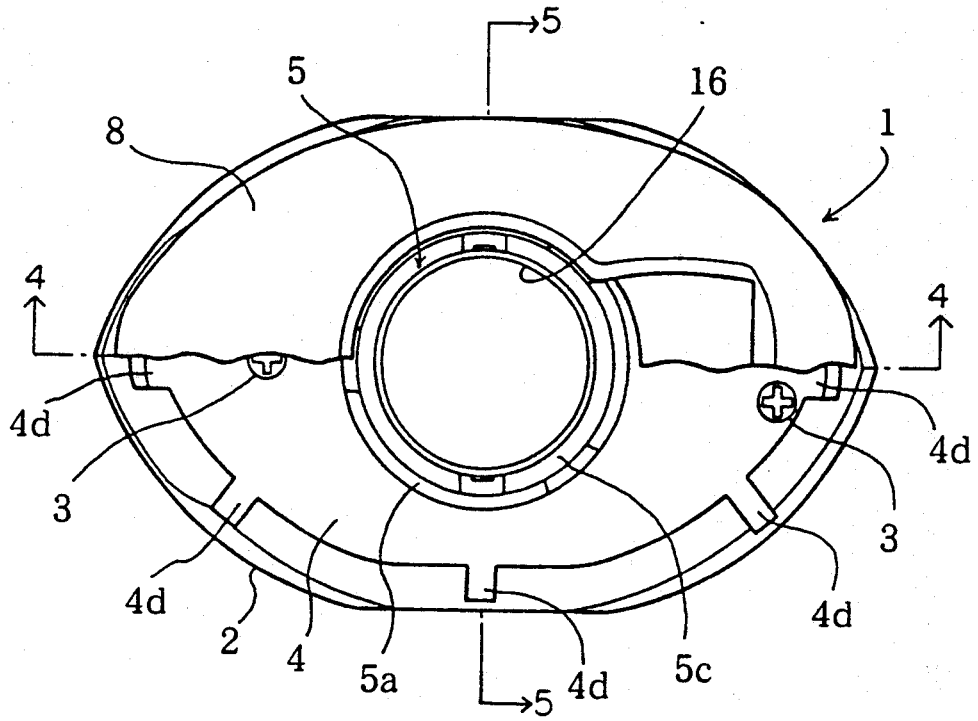
FIG. 3 is a partly cut-away plan view of the embodiment of FIG. 1

On the entire peripheral edge of the lower side of the mounting plate 4, there provided a ridge 4*a* which is opens downwardly. Within this ridge 4*a*, there is defined an air-feeding space 4*b* which is in communication within the engaging member 5. The mounting plate 4 includes two bosses 4*c*, which are fitted over the first and second screw-receiving members 10*a* and 10*b* to screw the plate 4 onto the ironing plate 2 by means of screws 3, while leaving a slight gap 4*e* therebetween. As illustrated in FIG. 3, a plurality of projecting pieces 4*d*, each of a small width, are located at given intervals on the periphery of the mounting plate 4. Each piece 4*d* is adapted to be fitted on the inside of the lower end of the covering member 8.

Figure 4:
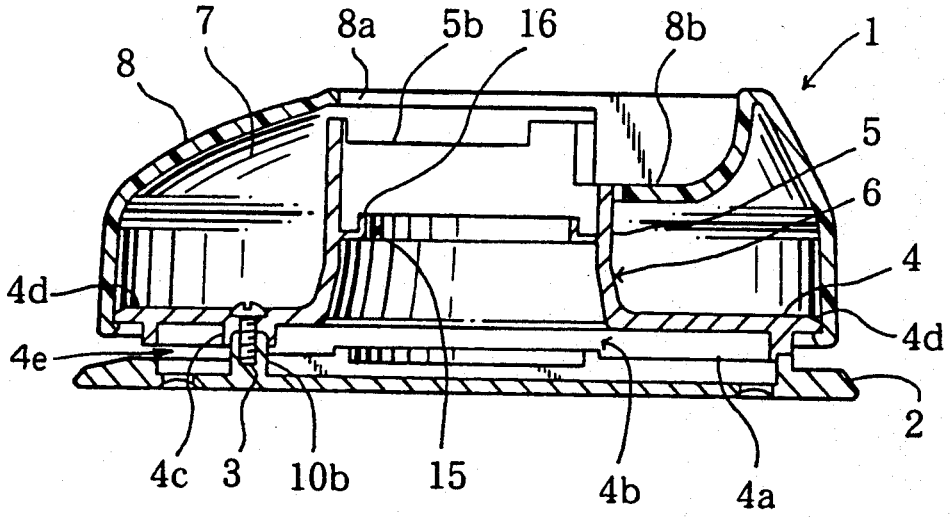
FIG. 4 is a sectional view of the embodiment of FIG. 1 taken along line 4—4 of FIG. 3 embodiment.
Figure 5:
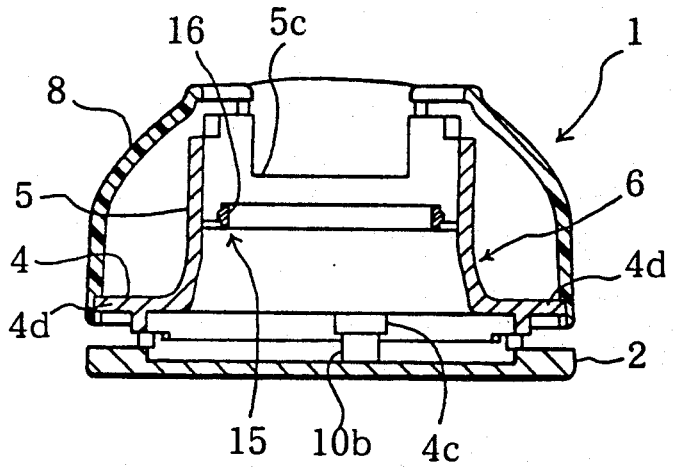
FIG. 5 is a sectional view taken along line 5—5 of FIG. 3.
Figure 6:
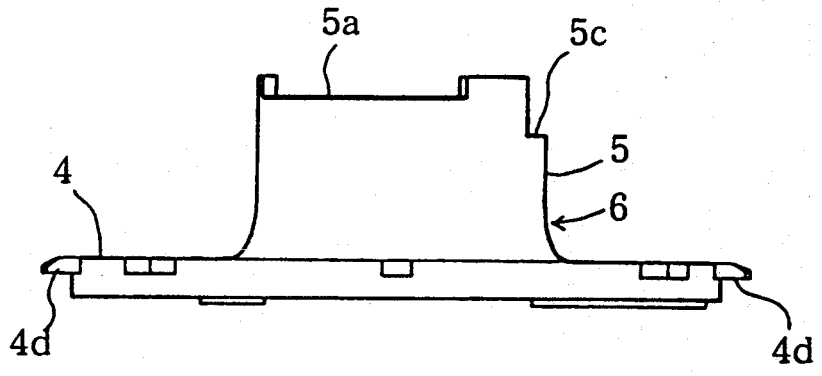
FIG. 6 is a side view of a hot air source receiver used in the embodiment of FIG. 1.

Extending upwardly from the central region of the mounting plate 4, the engaging member 5 is symmetrically provided with first and second notches 5*a* and 5*b*, as illustrated in FIGS. 3 and 4, and further includes a third notch 5*c* deeper than the 1st and 2nd notches.

Figure 10:
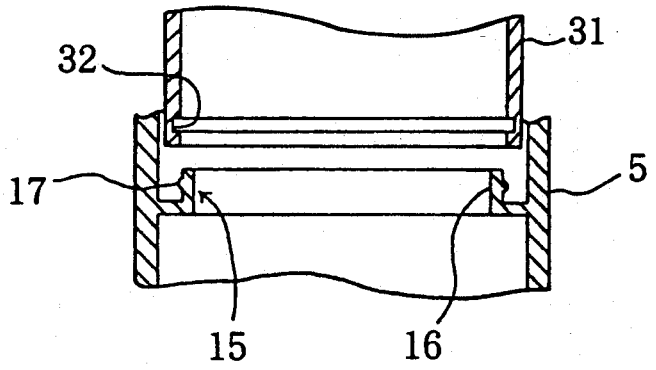
FIG. 10 is an enlarged sectional view of an engaging structure of the hot air source receiver.

Within the engaging member 5, there is provided an engaging structure 15 engageable with a hot air blower 31 of a hair dryer 30. As illustrated in FIG. 10, the engaging means 15 is formed by embossing a receiver means 16 located coaxially with the engaging member 5 to provide a small protrusion 17 on its outside. This protrusion 17 is engaged within a recess 32 formed in the hot air blower 31.

For the same purpose, ribs may be provided on the inside of the engaging member 5 in any desired number, although not illustrated.

Formed of a synthetic resin, the covering member 8 is in the form of a dome open on the lower side, is provided in a substantially central region with a hole 8*a* having a diameter slightly larger than the outer diameter of the engaging member 5 and includes a recess 8*b* corresponding to the above-mentioned third notch 5*c*. The covering member 8 is attached to the mounting plate 4 by engaging the projecting pieces 4*d* of the mounting plate 4 with the periphery of the lower end of the covering member 8. According to such an arrangement, the space defined by the covering member 8 is in communication with the outside through the gaps between the projecting pieces 4*d* and through the 1st, 2nd and 3rd notches 5*a*, 5*b* and 5*c*.

Reference will now be made to how the above-mentioned iron unit 1 works.

Figure 11:
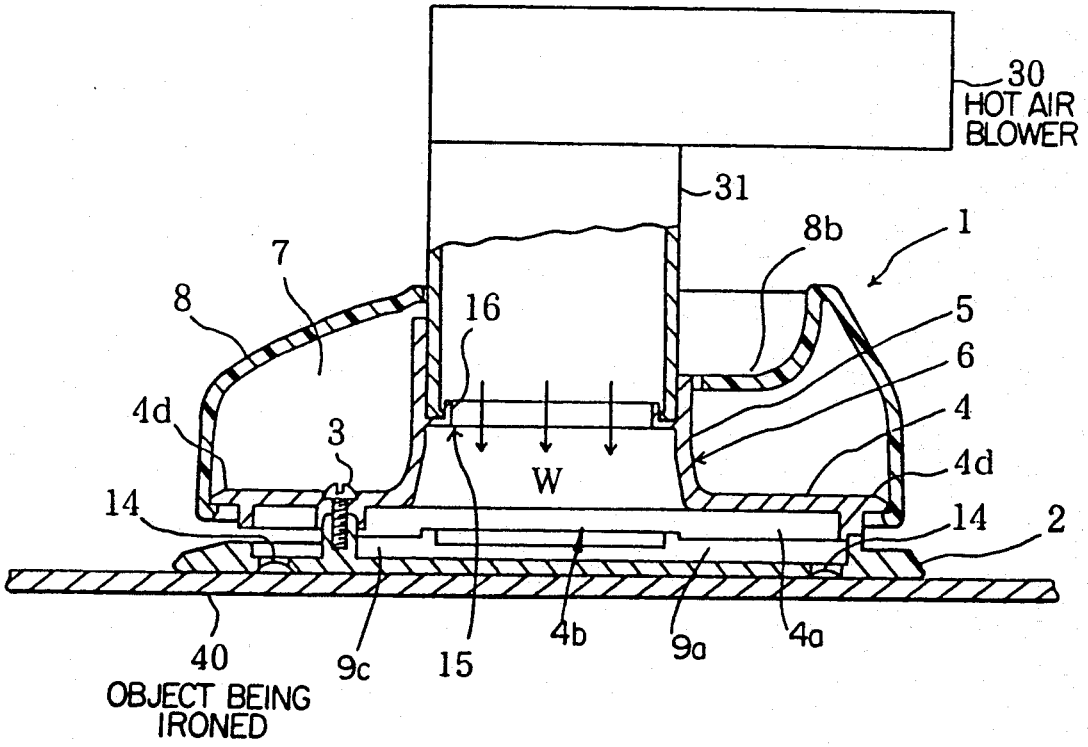
FIG. 11 is a sectional view of the embodiment of FIG. 1 in use.

As illustrated in FIG. 11, the hair dryer 30 is actuated, while the hot air blower 31, serving as a hot air source, is engaged with the engaging structure 15 of the engaging member 5, thereby feeding hot air W from the blower 31 into the engaging member 5. The hot air W is supplied from within the member 5 onto the upper face of the ironing plate 2 through the hot air feeding space 4*b*, above the mounting plate 4. Then, the hot air W is jetted through a number of the air outlets 14 onto an object 40 to be heated, the object being in contact with the lower side of the ironing plate 2. At the same time, the ironing plate 2 is heated by the hot air W. The ironing plate 2 is then moved along the upper side of the object 40 together with the hair dryer 30 serving as a hot air source, thereby ironing out the object 40.

While the iron unit 1 works in this way, a part of the hot air W blown out of the lower side of the ironing plate 2 escapes to the outside from the ironing plate 2 via the grooves 11*a* and 11*b* and the exhaust grooves 12*a*, 12*b*, 13*a* and 13*b*, so that the ironing plate 2 can be prevented from becoming too hot.

Although the air confined in the space 7 is heated by the hot air W, it is unlikely to become too hot, since the space 7 is in communication with the outside through the respective projecting pieces 4*d* and the first through third notches 5*a*–5*c*. Moreover, a part of the hot air W escapes from a slight gap between the ironing plate 2 and the mounting plate 4 by the between first through third ridges 9*a*–9*c*. This is also effective for preventing the ironing plate 2 from becoming too hot.

Another iron unit 1A having an additional holder 20 will now be explained with reference to FIGS. 12–15.

Figure 13:
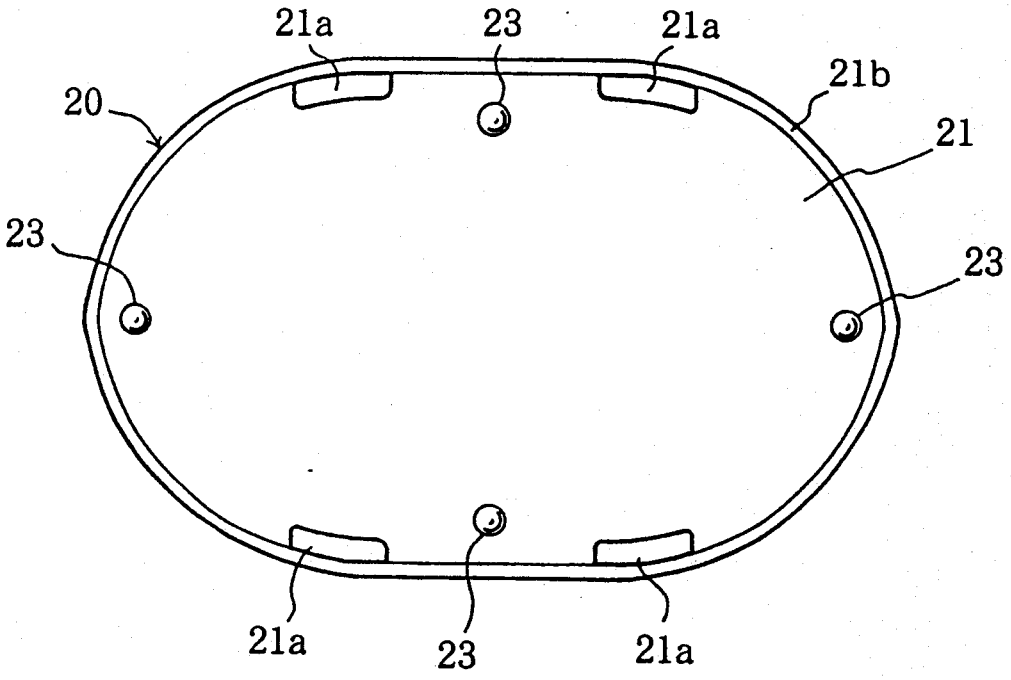
FIG. 13 is a plan view of a holder.
Figure 14:
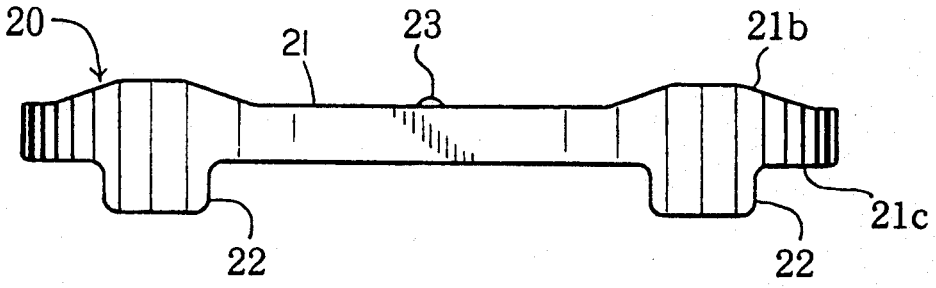
FIG. 14 is a side view of the holder of FIG. 13.
Figure 15:
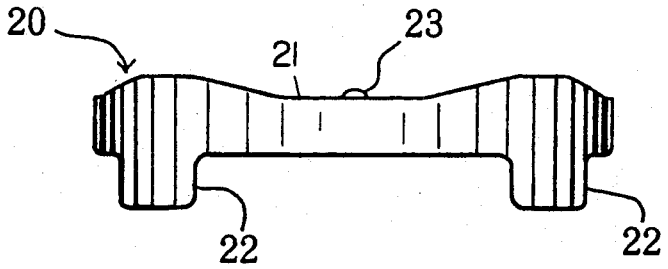
FIG. 15 is a front view of the holder of FIG. 13.

As illustrated in FIGS. 13–15, the holder 20 of the iron unit 1A according to the instant embodiment includes a substantially oval holder plate 21 formed of a synthetic resin, somewhat larger in its entire size than the ironing plate 2 and four legs 22 for holding the holder plate 21 up from the floor.

The holder plate 21 is provided on its upper and lower sides with a total eight bosses 23, four on each side, thereby holding the ironing plate 2 above the holder plate 21 when the ironing plate 2 placed on the holder plate 21. Collars 21*b* and 21*c* extend upwardly and downwardly from the periphery of the holder plate 21.

Figure 12:
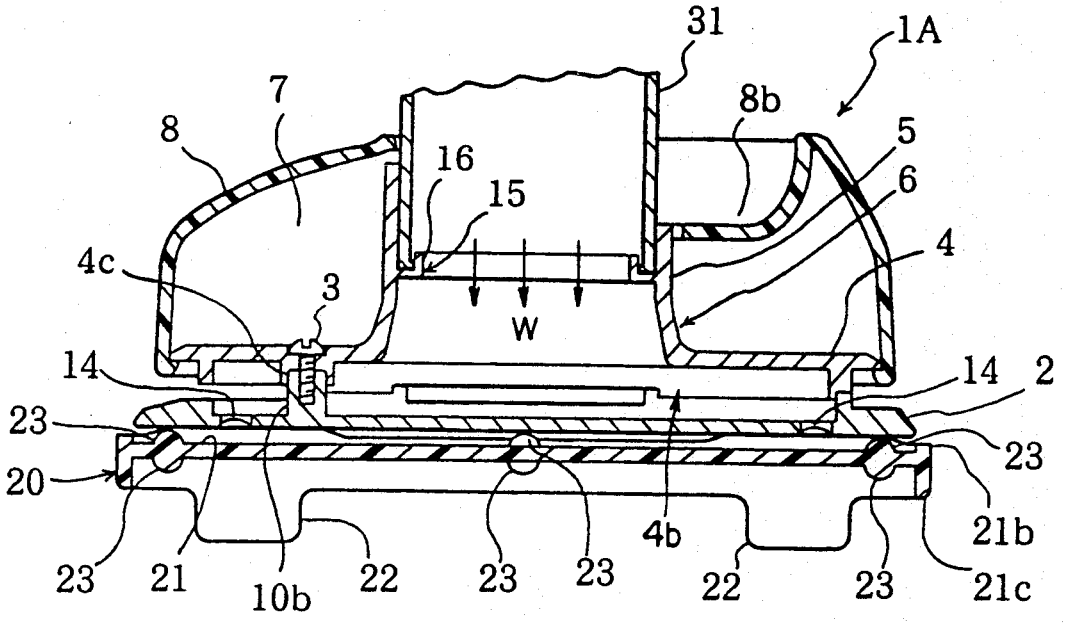
FIG. 12 is a sectional view of an embodiment according to a second aspect of the present invention.

When hot air W is accidentally supplied from the hair dryer 30 serving as the hot air source to the ironing plate 2 while it is placed on the holder 20, as illustrated in FIG. 12, the hot air W blown downwardly from the ironing plate 2 escapes from gaps between the respective legs 22 through vent holes 21*a* formed in the holder plate 21, so that the heating element 2 can be prevented from becoming too hot, thus contributing to greater safety in use.

With the iron unit 1A additionally provided with the holder 20 including the holder plate 21, it is possible to produce an increased effect in preventing the heating ironing plate 2 from becoming too hot and to stabilize the heating element while it is held in place.

Although the present invention has been described specifically with reference to its preferred embodiments, it is understood that many other modifications or changes are possible within the scope of the invention defined by the appended claims.

What is claimed is:

1. An ironing unit, comprising:

an ironing plate made of a heat conductive material, said ironing plate having a lower ironing side and an upper side, air outlets extending through said ironing plate from said upper side to said lower side, at least one first groove in said ironing plate on said lower side thereof communication with said air outlets and at least one exhaust groove communicating with each said first groove for exhausting air from each said first groove;

a hot air source receiver attached to said ironing plate, said hot air source receiver comprising a mounting plate connected to said ironing plate, and defining a hot air feeding space therebetween, said hot air feeding space communicating with said air outlets on said upper side of said ironing plate, and a cylindrical member on said mounting plate communicating with said hot air feeding space, said cylindrical member being engageable with a hair dryer for supplying hot air to said hot air feeding space, and said hot air source receiver further having a plurality of passages communicating said hot air feeding space with the exterior; and a covering member defining a space outside of said cylindrical member and said mounting plate of said hot air source receiver, said covering member being attached to said hot air source receiver, and said space communicating with the exterior of said covering member via passages defined about the periphery of said mounting plate and on a side of said cylindrical member.

2. The ironing unit of claim 1, and further comprising a holder plate for receiving said ironing plate thereon, a support on said holder plate for supporting said holder plate spaced from a supporting surface and a vent hole extending through said holder plate.

3. An ironing unit, comprising:

an ironing plate made of a heat conductive material, said ironing plate having a lower ironing side and an upper side, air outlets extending through said ironing plate from said upper side to said lower side, at least one first groove in said ironing plate on said lower side thereof communication with said air outlets and at least one exhaust groove communicating with each said first groove for exhausting air from each said first groove;

a hot air source receiver attached to said ironing plate, comprising means for receiving a hot air source, defining a hot air feeding space above said upper side of said ironing plate and for exhausting hot air from said hot air feeding space to the exterior thereof; and a covering member covering and defining a space around said hot air source receiver, said covering member and said hot air source receiver together defining passages communicating said space with the exterior of said covering member.

4. The ironing unit of claim 3, wherein each of said air outlets in said ironing plate extends therethrough to a said first groove, and each of said exhaust grooves extends along said lower side from a said first groove to a lateral edge of said ironing plate.

5. The ironing unit of claim 4, wherein:

said hot air source receiver comprises a mounting plate screwed to said ironing plate with a space therebetween communicating with said hot air feeding space; and said ironing plate has a plurality of projections on said upper side defining passages therebetween together with said mounting plate as said means for exhausting hot air from said hot air feeding space.

6. The ironing unit of claim 3, wherein:

said hot air source receiver comprises a cylindrical member for receiving a hair dryer having a plurality of notches therein; and said space defined by said covering member communicates with the exterior through said notches, said notches defining at least part of said passages.

7. The ironing unit of claim 3, wherein:

said hot air source receiver comprises a mounting plate attached to said ironing plate, said mounting plate having a plurality of projecting pieces projecting from spaced locations about the periphery of said mounting plate; and said covering member has an inner surface engaged with said projecting pieces to mount said covering member on said hot air source receiver, the spaces between said projecting pieces defining at least a part of said passages communicating said space with the exterior of said covering member.

8. The ironing unit of claim 3, and further comprising a holder plate for receiving said ironing plate thereon, a support on said holder plate for supporting said holder plate spaced from a supporting surface and a vent hole extending through said holder plate.

* * * * *